United States Patent [19]

Nielsen

[11] 4,032,070

[45] June 28, 1977

[54] THERMOSTATIC EXPANSION VALVE FOR REFRIGERATION INSTALLATIONS

[75] Inventor: Leif Nielsen, Nordborg, Denmark

[73] Assignee: Danfoss A/S, Nordborg, Denmark

[22] Filed: Sept. 2, 1975

[21] Appl. No.: 609,608

Related U.S. Application Data

[63] Continuation of Ser. No. 495,384, Aug. 7, 1974, abandoned.

[52] U.S. Cl. ..... 236/92 B; 62/225; 137/503

[51] Int. Cl.² ..... F25B 41/04

[58] Field of Search ..... 236/92 B, 806; 62/DIG. 17, 527, 225, 528; 137/503, 508, 504

[56] References Cited

UNITED STATES PATENTS

| | | | |
|---|---|---|---|
| 2,004,822 | 6/1935 | Mercier | 137/508 X |
| 2,960,845 | 11/1960 | Lange | 62/210 X |
| 3,118,494 | 1/1964 | Yost et al. | 137/508 X |
| 3,478,774 | 11/1969 | Noakes et al. | 236/92 B |
| 3,903,916 | 9/1975 | Waletzko | 137/508 |

FOREIGN PATENTS OR APPLICATIONS

| | | | |
|---|---|---|---|
| 670,751 | 9/1963 | Canada | 236/92 B |

*Primary Examiner*—William E. Wayner

[57] ABSTRACT

The invention relates to a thermostatic expansion valve assembly for a refrigeration installation of the type having condenser and evaporator units. The valve assembly controls the flow of refrigerant between the condenser and the evaporator and has a conventional operating unit which is dependent upon the superheat temperature of the evaporator. Condenser pressure for summer operation is on the order of being five to ten times greater than for winter operation and this represents a greater flow quantity. Compensation for this variance in condenser pressure is provided by a seat and closure member design in which the valve is caused to open at a slower rate than any increase in the condenser pressure. This is done by equipping the closure and valve seat with a piston and cylinder construction which defines an expansible chamber which has fluid communication with the condenser inlet port. An increase in condenser pressure causes expansion of the expansible chamber which in turn effects a closing force on the valve parts.

1 Claim, 4 Drawing Figures

THERMOSTATIC EXPANSION VALVE FOR REFRIGERATION INSTALLATIONS

This is a continuation application of Ser. No. 495,384, filed Aug. 7, 1974, now abandoned.

The invention relates to a thermostatic expansion valve for refrigeration installations, especially with an air-cooled condenser with an operating element which is dependent upon the superheat temperature of the evaporator and which actuates a closing member co-operating with a seat.

Thermostatic expansion valves are fitted between the condenser and the evaporator of a refrigerating installation. Their function is to supply so much refrigerant to the evaporator that the superheat temperature at the end of the evaporator remains substantially constant. They must also be capable of providing a complete seal between the evaporator and the condenser. The operating element may also be acted upon by the suction pressure in order to achieve relief of pressure.

Whereas it can be assumed that the evaporator pressure is constant or under goes only slight changes, the condenser pressure varies considerably in dependence upon the condenser temperature. In the case of air-cooled condensers, the condenser pressures that occur in summer are 5–10 times greater than those occurring in winter. Since a greater pressure-difference for a given position of the valve leads to a greater flow quantity, the factors upon which adjustment depends are quite different in summer from these obtaining in winter. If the expansion valve is designed for summer-time operation, then in winter it lets through to little refrigerant even when fully open, i.e. when in a position corresponding to a predetermined maximum superheat temperature. If on the other hand the valve is designed for winter-time operation, the required flow-restriction cross-section is exceeded even at quite low superheat temperatures. In the case of expansion valves in which the inlet pressure is not compensated, there also occurs undesirable displacement of the closing member relative to the position dependent upon the superheat temperature, this displacement being dependent upon the condenser pressure.

The object of the present invention is to provide a thermostatic expansion valve of the initially described kind, the adjustment characteristic curve of which is considerably less dependent than heretofore upon fluctuations in the condenser pressure.

According to the invention this object is achieved in that the seat is carried by a piston which is axially displaceable in the valve housing and to one face of which is applied the condenser pressure while the evaporator pressure and the source of a reference spring are applied to its other face.

There is thus created a valve which is practically independent of the pressure-drop, since any change in this pressure-drop is compensated in the valve itself by a corresponding change in flow restriction so that the flow quantity, dependent upon the superheat temperature of the evaporator, remains at approximately the same value. Depending upon the pressure-drop, the piston carrying the seat moves into a position of equilibrium which is determined by the characteristic curve of the spring and in which the required correction is achieved.

A further solution to the same problem consists in the closing member being carried by a piston which is displaceable relatively to a base coupled to the operating element and to one free of which piston is applied the condenser pressure while the evaporator pressure and the force of a reference spring are applied to its other face. In this arrangement and in dependence upon the pressure-drop, the piston carrying the closing member moves into a position of equilibrium which is determined by the characteristic curve of the spring and in which the required correction is obtained.

In a preferred embodiment, the base is a cylinder which is closed at one end by a wall and in which the piston is adapted to move, the space between the piston and the wall being connected to the inlet side of the valve by way of a duct extending through the closing member, and the reference spring being supported by a shoulder on the cylinder.

The invention will now be described in greater detail by reference to preferred embodiments illustrated in the drawings, in which.

Figure 4:
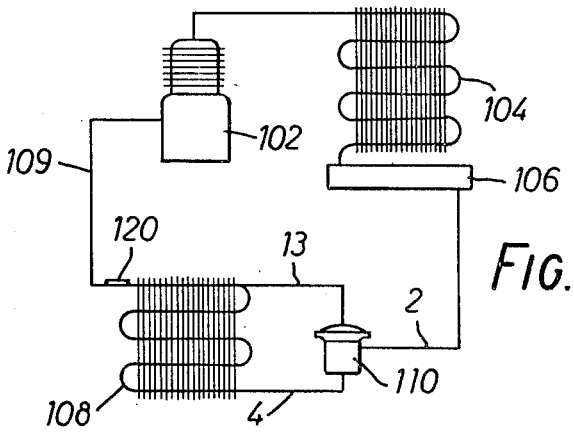
FIG. 4 shows the improved expansion valve installed in a refrigeration system.

With reference to FIG. 4, a compressor 102 compresses a refrigerant and directs it to an air cooled condenser 104. The refrigerant in gaseous form flows from the condenser receiver 106 through line 2 to a thermostatic expansion valve unit 110, through a line 4 to an evaporator 108, and through a return line 109 back to the compressor. The valve unit 110 controls the flow of refrigerant to the evaporator 108. A heat sensing bulb 120 having a fluid refrigerant charge is on the downstream side of the evaporator 108 at a point where the temperature is controlled. A capillary tube 13 provides feedback control for the valve unit 110 so that the flow of refrigerant to the evaporator is dictated by the temperature sensed by the bulb 120 at the outlet end of the evaporator.

Figure 1:
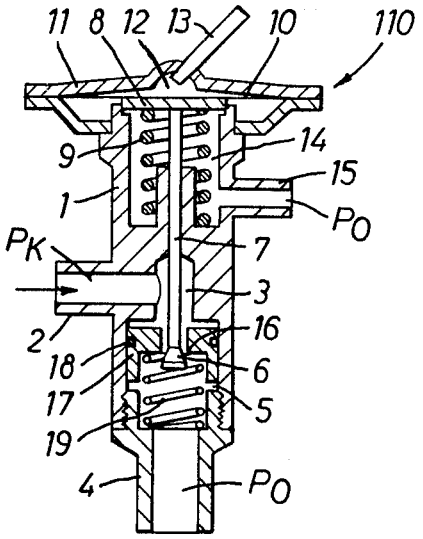
FIG. 1 shows a longitudinal section through a first form of expansion valve in accordance with the invention.

In the arrangement shown in FIG. 1, a housing 1 of a thermostatic expansion valve has an inlet port 2 for connection to the condenser, this port being contiguous with an inlet duct 3; the housing also has an outlet port 4 which is for connection to the evaporator and has an upstream outlet duct 5. A closing member 6 is carried by a valve spindle 7, extending through the housing, and at the top end communicates with a pressure plate 8 which is loaded on one of its faces by a required-value spring 9 and on the other by the diaphragm 10 of an operating element 11. The space 12 in the operating element communicates with a temperature sensor by way of a capillary tube 13 and contains vapor at a pressure dependent upon the temperature of the sensor. The space 14 below the diaphragm communicates with the outlet pressure by way of port 15.

Here, as in the other example, the inlet or condenser pressure is designated by $P_k$ and the outlet or evaporator pressure by $P_o$.

The seat 16 is formed on a piston 17 which is displaceable in the housing 1 and which has a sealing ring 18 at its circumference. The piston 17 is loaded from above by the condenser pressure $P_k$ and from below by the evaporator pressure $P_o$ and a reference spring 19.

As a predetermined vapor pressure in the operating element 11 the closing member 6 occupies a specified position of equilibrium. At a given condenser pressure this leads to a specific flow-restricting position of the valve. If the condenser pressure then rises, the piston 17 is displaced downwardly into a new position, the reference spring 19 being thereby compressed. With an appropriate spring characteristic curve, the flow quantity, in this new position of the piston, is substantially equal to the flow quantity at the lower condenser pressure despite this pressure being higher.

Where the same parts as in FIG. 1 are used in the next example, the same reference symbols are used for them.

Figure 2:
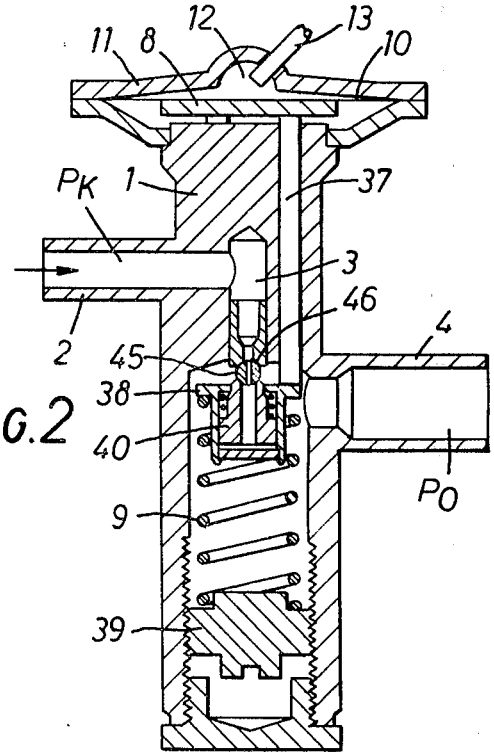
FIG. 2 shows a longitudinal section through a second form.
Figure 3:
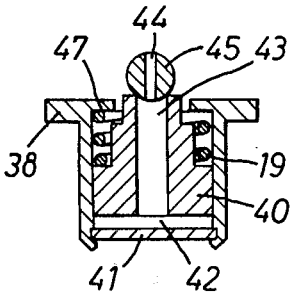
FIG. 3 shows a portion from FIG. 2, on a larger scale.

In the arrangement shown in FIGS. 2 and 3, the pressure plate 8 acts, by way of a plurality of valve spindles 37 on a base 38 formed as a cylinder which in turn is loaded by the required-value spring 9. The required-value spring can be adjusted by means of a set-screw 39. As shown more clearly in FIG. 3, a piston 40 is provided in the cylindrical base 38 and, with the bottom 41 of the base 38, delimits a space 42. This space communicates with the inlet duct 3 through a duct 43 in the piston 40 and a duct 44 in a spherical closing member 45. The spherical closing member 45 co-operates with a valve seat 46 secured to the housing. The piston 40 is also loaded by the reference spring 19 which is supported on a shoulder 47 of the base 38.

In this arrangement the base 38 determines the basic position of the closing member. The piston 40, which is held in a position of equilibrium by the pressure-drop and the spring 19, brings about the required commpensation, so that the flow-restricting position of the closing member 45 in relation to the seat 46 is dependent both upon the adjustment amount and the pressure-drop.

I claim:

1. A thermostatic expansion valve assembly for a refrigeration installation of the type having condenser and evaporator units, comprising, a housing, a condenser inlet port and an evaporator outlet port in said housing, an operating unit having a chamber pressure responsive to the superheat temperature of said evaporator unit, valve means between said ports including a piston and a cylinder with said piston being reciprocally mounted in said cylinder, a central opening in said piston forming a movable valve seat carried by said piston, said operating unit including a centrally disposed rod extending through said piston opening, said valve means including a closure member attached to the lower end of said rod which is cooperable with said valve seat, spring means biasing said piston in an upstream valve opening direction, said piston pressure biasable by condenser pressure in a downstream valve closing direction, said operating unit being operable to move said rod and closure member thereof in a valve opening direction, said spring means having a characteristic curve relative to a range of values of said condenser pressure to maintain a flow quantity through said valve means over said range of condenser pressure values which corresponds only to said operating unit chamber pressure.

* * * * *